United States Patent [19]

Baker

[11] 4,044,803

[45] Aug. 30, 1977

[54] APPARATUS FOR FILLING CONTAINERS WITH DEHYDRATED AGGLOMERATES

[76] Inventor: Woodrow A. Baker, 13979 Allen Road, Albion, N.Y. 14411

[21] Appl. No.: 621,875

[22] Filed: Oct. 14, 1975

[51] Int. Cl.[2] ..... B65B 1/14

[52] U.S. Cl. ..... 141/34; 222/410

[58] Field of Search ..... 141/31, 69, 296, 257, 141/34; 222/410, 461, 169; 23/273 SP, 273 V, 301 SP; 156/615, 617 SP

[56] References Cited

U.S. PATENT DOCUMENTS

| | | | |
|---|---|---|---|
| 2,692,702 | 10/1954 | Church | 222/410 |
| 2,778,387 | 1/1957 | Diehl | 141/257 |
| 2,920,793 | 1/1960 | Munsell | 222/410 |
| 3,960,503 | 6/1976 | Rice | 222/410 |

*Primary Examiner*—Houston S. Bell, Jr.

[57] ABSTRACT

A machine for packaging dehydrated food particles has at least one filling station at which an elongate sleeve is mounted for rotation about a vertical axis. A saucer-shaped plate is mounted horizontally beneath the lower end of said sleeve by an adjustable clamp which secures the plate to the sleeve for rotation therewith, and for axial adjustment toward and away from the lower end of the sleeve. In operation dehydrated particles are fed into the upper end of the sleeve normally to pile up on the plate and to back up into the sleeve to fill its bore. The sleeve and plate are intermittently rotated to cause predetermined quantities of the product to be flung outwardly over the lip of the plate, and to drop through a chute to containers which are advanced one by one past the station. The dehydrated product is therefore not subjected to any compacting during packaging.

5 Claims, 2 Drawing Figures

FIG. 1
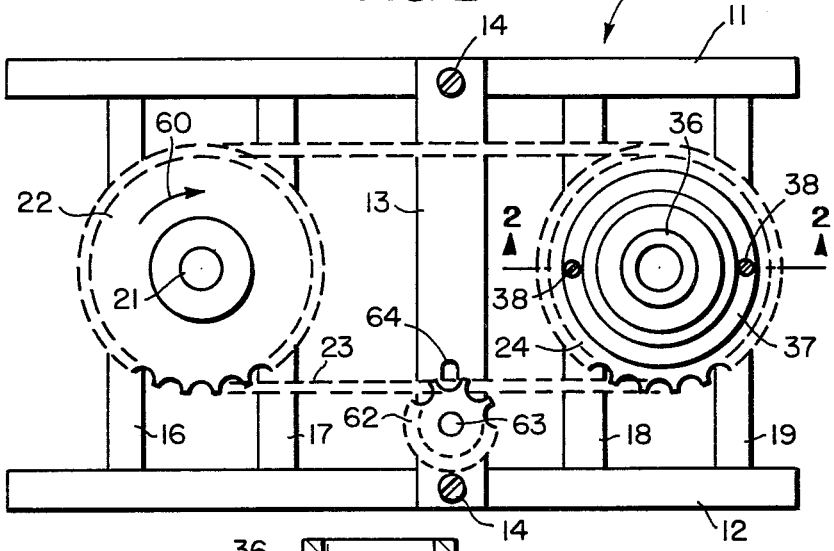
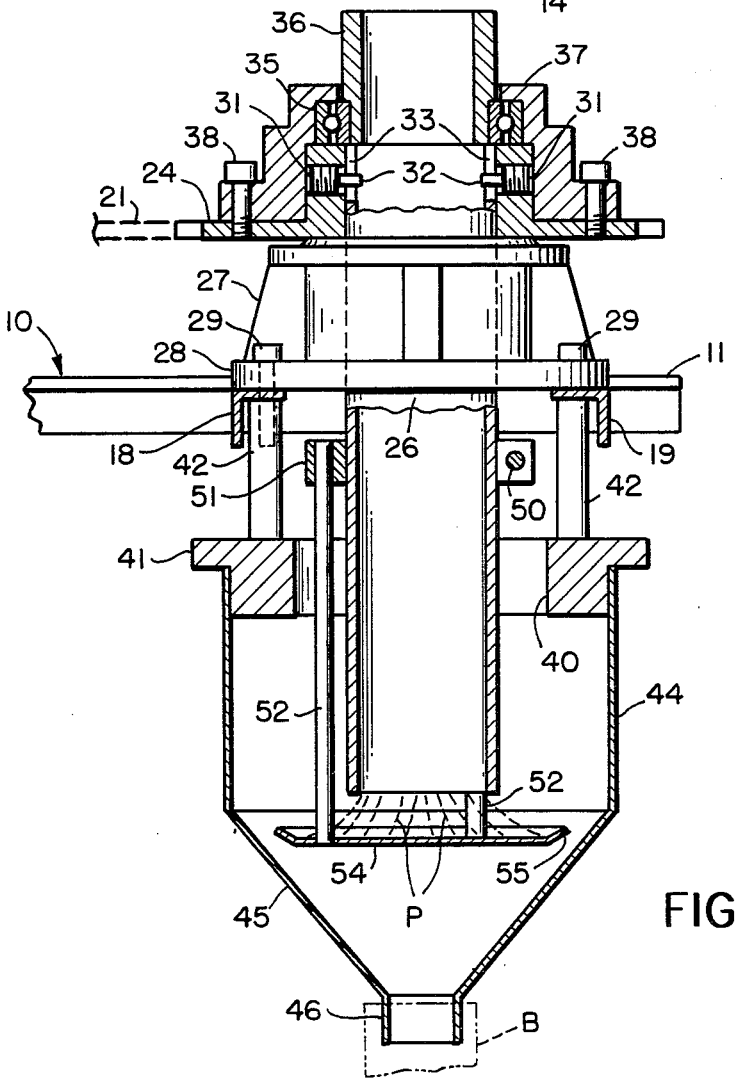
FIG. 2

APPARATUS FOR FILLING CONTAINERS WITH DEHYDRATED AGGLOMERATES

This invention relates to the packaging of dehydrated food products, and more particularly to improved apparatus for accurately dispensing predetermined quantities of dehydrated foods of the agglomerated type into small bags or containers.

It is common practice to market various dehydrated foods in small packages containing quantities sufficient to provide individual servings or multiples thereof. Such so-called "instant" preparations include, among other items, dehydrated soups in the form of dry powders or granules that are packaged in small foil envelopes. Typically the dehydrated soup can be reconstituted merely by pouring the contents of the envelope into a cup or bowl, and then stirring in a cup of hot water, or the like, which immediately rehydrates the powder or granules. The exact quantity of dehydrated material carried in the envelope or container may, of course, vary, depending upon the intended size of the serving.

One of the problems heretofore encountered in rehydrating dehydrated food products has been the tendency of the dry, dehydrated particles or powder to form tiny lumps when the rehydrating liquid is added. This problem has been obviated to a great extent in connection with dehydrated soups of the "cream" variety by utilizing an agglomerated-type of dry particle, which is produced by a process that forms no part of this invention. If properly packaged, these agglomerated food particles will readily rehydrate without lumping upon the addition of the rehydrating liquid. It has been discovered, however, that if such agglomerated particles are in any way compacted or otherwise subjected to undesirable outside pressures before or during packaging, they will tend to form undesirable lumps when mixed with the rehydrating liquid.

This compacting of the dehydrated agglomerated food particles has been encounted heretofore in conventional filling machines of the type in which predetermined or measured quantities of the agglomerated particles are fed to individual containers or envelopes which are advanced one by one past each of one or more filling or loading stations in the machine.

For example, in one such machine it has been customary to fill a hopper at each station with a supply of agglomerated food particles, which are driven from a small opening in the bottom of the hopper by a centrally disposed auger, which intermittently rotates and drives the particles downwardly into a saucer-shaped dispenser, which is positioned beneath the bottom of the hopper. The dispenser is fixed to rotate intermittently with the auger, so that each time the auger and dispenser rotate part of the quantity of agglomerated particles which has built up on the dispenser beneath the hopper opening is thrown outwardly by centrifugal force over the circumferential edge or lip of the dispenser, and is guided downwardly through a chute into the upper ends of the envelopes or packages which are conveyed one by one beneath the discharge end of the chute. Simultaneously the rotating auger forces a quantity of granules downwardly out of the lower end of the hopper to replenish the portion which was thrown from the dispenser.

A primary disadvantage of filling apparatus of the type described in that a rather high percentage of the granules packaged in this manner tend to form lumps in the rehydrating liquid, apparently as the result of undesirable compacting during the filling process.

It is an object of this invention, therefore, to provide an improved method and apparatus for packaging dehydrated food particles of the type described, and which effectively illiminate the undesirable lumping which resulted heretofore upon the rehydration of such particles.

Another object of this invention is to provide improved filler apparatus of the type described which is substantially more accurate than prior such apparatus.

Still another object of this invention is to provide filler apparatus of the type described which is readily adjustable selectively to increase or decrease the quantity of particles discharged from the apparatus each time it is operated.

Another object of this invention is to provide improved filler apparatus which avoids any undesirable compacting of dry, dehydrated food particles during the packaging thereof.

Other objects of the invention will be apparent hereinafter from the specification and from the recital of the appended claims, particularly when read in conjunction with the accompanying drawing.

In the drawing:

FIG. 1 is a fragmentary plan view of filling apparatus made according to one embodiment of this invention; and FIG. 2 is an enlarged, fragmentary sectional view taken generally along the line 2—2 in FIG. 1 looking in the direction of the arrows.

Referring now to the drawing by numerals of reference, 10 denotes generally a frame by means of which filler apparatus made according to this invention can be attached to a conventional filling machine of the type in which predetermined quantities of a dehydrated food product in granular form may be dispensed intermittently at one or more filling stations into successive bags or containers, which are advanced one by one past each station beneath a discharge chute which guides the dispensed portion of the product into the upper, open end of each container, after which each container is sealed in known manner. The overall construction of a packaging machine of this type is well known in the art, and forms no part of the instant invention.

Frame 10 comprises a pair of spaced, parallel side members or angle irons 11 and 12, and a central, transversely extending bar 13 which is secured at opposite ends by screws 14 or the like to the tops of the members 11 and 12. Welded or otherwise secured at opposite ends to the undersides of members 11 and 12, and extending transversely therebetween adjacent opposite sides of the bar 13, are two pairs of spaced, parallel angle irons 16, 17 and 18, 19, respectively.

Mounted in any conventional manner to have its upper end rotate between the frame members 16 and 17 is a vertically disposed drive shaft 21. Secured to the upper end of shaft 21 for rotation thereby in a horizontal plane above the members 16 and 17 is a sprocket wheel 22. This wheel is connected by a chain 23 to a similar sprocket wheel 24, which is mounted on the upper end of a sleeve 26 that is mounted to rotate about a vertical axis between the frame members 18 and 19. Sleeve 26 is rotatably journaled intermediate its ends in a bracket 27, which has a flange 28 secured by bolts 29 to the upper surfaces of members 18 and 19. Two set screws 31, which are threaded into diametrally opposed, radial openings in the hub of wheel 24, have reduced diameter inner ends 32 which project into a pair of vertical slots 33 that are formed in the upper end of sleeve 26 at diametrically opposite sides thereof, thereby drivingly to connect wheel 24 to sleeve 26.

Secured at its lower end in the bore of a roller bearing 35, which is mounted coaxially above sleeve 26 and the hub of sprocket wheel 24, is a further sleeve 36, the inner diameter of which is slightly smaller than the inner diameter of sleeve 26. Bearing 35 is surrounded and enclosed by the upper end of an inverted, generally cup-shaped dust cover 37, which also surrounds the hub of the sprocket wheel 24, and which is removably fastened on the upper surface of this wheel by bolts 38.

Sleeve 26 projects downwardly beneath the bracket 27 and coaxially through the bore 40 in an annular, chute-supporting member 41, which is suspended beneath the frame members 18 and 19 by a plurality of vertically disposed pins 42. Secured at its upper end to member 41 coaxially thereof, and projecting coaxially downwardly in radially-spaced relation to the sleeve 26, is a generally funnel-shaped chute 44. Intermediate its ends chute 44 has an inverted, generally truncated-conical portion 45, which communicates at the lower end of the chute with a cylindrical outlet or discharge 46.

Adjustably secured by a screw 50 to the outer peripheral surface of the sleeve 26 for axial adjustment thereon above the chute-support 41 is a generally C-shaped clamp 51. Secured at their upper ends to the clamp 51, and projecting downwardly through the bore in member 41 at equiangularly spaced points around the outside of sleeve 26, are three, elongate rods 52, only two of which are shown in FIG. 2. Secured to the lower ends of rods 52 to be supported thereby horizontally beneath the lower end of the sleeve 26, and coaxially thereof, is a generally saucer-shaped spinner or dispenser plate 54. Plate 54 is located adjacent the upper end of the cone-shaped portion 45 of the chute 44, and has an upwardly-inclined peripheral edge or lip portion 55 disposed in radially spaced relation to the inside wall of the chute.

In use, the upper sleeve 36 is connected in any conventional manner to a supply of agglomerated, dehydrated food particles, such as for example dehydrated cream of chicken soup, or the like. The clamp 51 is adjusted vertically on sleeve 26 so that the plate 54 is spaced slightly beneath the lower, open end of sleeve 26. In this position plate 54 partially obstructs the lower end of this sleeve, so that particles fed through the sleeve 36 into the bore of sleeve 26 tend normally to accumulate in a pile P on the plate 54, as denoted for example by the broken lines in FIG. 2. This pile blocks the lower end of sleeve 26 and causes remaining particles to back up into and accumulate within the bore of the sleeve.

When the associated machine is in operation, small containers or bags B are advanced one by one beneath the discharge end 46 of the chute 44, so that any particles falling from plate 54 will be guided into the upper, open end of a bag. Also at this time, and by conventional means which form no part of this invention, the drive shaft 21 is intermittently rotated or indexed in one direction, as indicated for example by the arrow 60 in FIG. 1. This rotational movement is transmitted by the wheel 22 and chain 23 to the sprocket wheel 24, which in turn rotates sleeve 26 and the attached dispensing plate 54. As is customary with filling apparatus of this type, and merely by way of example, each indexing movement of the drive shaft 21 rotates the sleeve 26 and plate 54 in unison a fraction of a revolution about the axis of sleeve 26. Each time the sleeve and plate are thus indexed, a predetermined quantity of particles from the pile P on plate 54 is caused to be thrown outwardly by centrifugal force over the lip 55 of the plate, so that gravity causes the discharged particles to fall downwardly through the chute 44 and its discharge 46 into the bag B or other container positioned therebeneath. Gravity causes the quantity of particles discharged from plate 54 to be automatically replenished from the supply of particles stored in the bore of sleeve 26.

The quantity of particles discharged over the lip 55 of the plate 54 each time it is indexed is a function of the distance that the plate 54 is spaced beneath the lower end of sleeve 26. This vertical spacing can be adjusted by loosening the screw 50 to enable the clamp 51 to be adjusted vertically on the sleeve 26. For example, if the quantity of particles discharged from the plate 54 each time it is indexed is too great, the plate is shifted upwardly relative to the lower end of sleeve 26, thereby throttling the opening in the lower end of sleeve 26, and consequently reducing the quantity which will be discharged over the lip 55 of the plate each time it is rotatably indexed. Conversely, to increase the quantity which will be thrown over the lip upon the indexing of the plate and sleeve, the plate 54 is adjusted axially downwardly from the lower end of sleeve 26 by means of its clamp 51.

To enable adjustment of the slack in the chain 23, an idler sprocket wheel 62 is rotatably mounted on a shaft 63, which is mounted vertically on the bar 13 of frame 10. The teeth of the sprocket wheel 62 engage one of the runs of the chain 23; and the shaft 63 is adjustable in a slot 64 in the bar 13 to increase or decrease the tension in the chain 23 in known manner.

From the foregoing it will be apparent that the instant invention provides relatively simple and reliable apparatus for dispensing predetermined quantities of dehydrated food products into separate containers substantially solely through the use of centrifugal and gravitational forces. Tests have indicated that this improved filling apparatus is substantially more accurate than prior apparatus of the type which employs an auger or similar device for positively feeding or forcing dehydrated particles out of the lower end of a supply hopper to an associated dispenser plate. For example, there are laws which require that the actual contents of a container fall within a certain percentage of its alleged contents, as indicated for example by the amount printed or otherwise displayed on the outside of the container. With known, prior filler apparatus it was extremely difficult to maintain a low tolerance with respect to the quantity of material discharged from the dispenser each time it was indexed. With the apparatus disclosed herein, however, it is possible consistently to discharge a quantity of particles which will fall within approximately plus or minus 5% of the desired quantity. This substantially reduces the number or rejects, or containers which must be set aside because they contain insufficient or excessive quantities of the dispensed product. Moreover, it has been determined apparatus of the type described can be operated at an increased rate as compared to of prior such apparatus, which makes it possible to speed up production, and to fill more containers per minute than was possible heretofore.

Still another important advantage of the apparatus disclosed herein is that the agglomerated particles are not subjected to any objectionable compacting during the feeding thereof from the supply to the ultimate containers therefor. Unlike the auger-type filler apparatus, there is absolutely no member located in sleeve 26 for the purpose of stirring its contents or for forcing the contents downwardly out of the bottom thereof onto the pan 64. On the contrary, the only force exerted on the particles in the sleeve 26 is caused by gravity; and the only force tending to discharge the particles radially from the plate 54 are the centrifugal forces created each time the sleeve 26 and pan 54 are indexed. Tests have indicated that the contents of containers filled from apparatus of the type disclosed herein tend readily to reconstitute or rehydrate without any lumping, when the rehydrating liquid is added thereto.

While this invention has been described in connection with the filling of containers with agglomerated, dehydrated food particles, other uses of the filling apparatus in connection for example, with other types of particles will be readily apparent to one skilled in the art, and this application is intended to cover any such modifications as may be readily apparent or which fall within the scope of the appended claims.

Having thus described my invention, what I claim is:

1. A machine for filling containers with predetermined quantities of dry particles, comprising a frame, indexing means including a drive shaft mounted on said frame to be intermittently rotated in one direction about its axis, a sleeve mounted on said frame for intermittent rotation by said drive shaft and coaxially about a vertical axis, said sleeve having an unobstructed axial bore disposed to be filled with said dry particles, means for connecting said bore of said sleeve adjacent its upper end to a supply of said dry particles to be filled thereby, a plate mounted on said sleeve for intermittent rotation therewith, and extending transversely across said lower end of said sleeve in axially spaced relation thereto partially to obstruct the opening in said lower end of said sleeve thereby normally to cause the particles filling said bore in the sleeve to pile up on the upper surface of said plate and to accumulate in said sleeve above said plate and the pile of particles thereon, said indexing means further including means connecting said sleeve to said shaft and operative to transmit the intermittent rotation of said shaft simultaneously to said sleeve and to said plate, and whereby each time said shaft is rotated said sleeve and said plate are rotated a fraction of a revolution about the axis of said sleeve so that a predetermined quantity of said particles is discharged by centrifugal force radially off the edge of said plate from said pile, and said pile is replenished by gravity from the particles accumulated in the unobstructed bore of said sleeve, and means for guiding into one of said containers said quantity of particles discharged from said plate.

2. The machine as defined in claim 1, including means adjustably mounting said plate on said sleeve for axial movement selectively toward and away from said lower end of said sleeve, thereby respectively to decrease or increase the quantity of particles discharged from said plate each time it is rotatably indexed.

3. The machine as defined in claim 2, wherein the last-named means comprises a clamp adjustably secured around the outside of said sleeve intermediate the ends thereof, and a plurality of rods arranged around the outside of said sleeve and fastened at one end to said clamp and at their opposite ends to said plate at angularly spaced points about its axis to support the plate horizontally beneath said sleeve.

4. The machine as defined in claim 1, wherein the unobstructed bore in said sleeve is spaced slightly above and in registry with a plane surface on said plate, whereby the particles in said bore are discharged downwardly through the lower end of said bore to replenish said pile solely as the result of gravitational forces.

5. The machine as defined in claim 1, wherein said means connecting said sleeve to said drive shaft comprises a sprocket wheel surrounding the upper end of said sleeve coaxially thereof and drivingly connected to said drive shaft, and at least one pin secured in one of the confronting surfaces on said sprocket wheel and said sleeve, respectively, and projecting into an axially-extending slot on the other of said confronting surfaces thereby to prevent relative rotation between said wheel and said sleeve, and to allow removal of said wheel axially from the upper end of said sleeve.

* * * * *